United States Patent [19]

Cornellier

[11] 4,103,716

[45] Aug. 1, 1978

[54] LENO MOTION DEVICE

[75] Inventor: Joseph Rene Cornellier, Knowlton, Canada

[73] Assignee: Neretex Corp., Chicago, Ill.

[21] Appl. No.: 786,596

[22] Filed: Apr. 11, 1977

[30] Foreign Application Priority Data

Mar. 15, 1977 [CA] Canada ..... 273993

[51] Int. Cl.[2] ..... D03D 7/00

[52] U.S. Cl. ..... 139/54

[58] Field of Search ..... 139/48, 50, 54, 430

[56] References Cited

U.S. PATENT DOCUMENTS 2,710,631 6/1955 Flamand ..... 139/54

2,918,092 12/1959 Paabo ..... 139/54

*Primary Examiner*—Henry S. Jaudon

*Attorney, Agent, or Firm*—McFadden, Fincham & Co.

[57] ABSTRACT

The present invention provides a selvage-forming device for use in a weaving apparatus, which selvage-forming device is of a relatively simple construction and yet effectively forms the selvage. The device comprises a rotatable plate upon which is mounted first and second supplies of thread. The thread from each supply of the same is preferably fed to a pre-guide member, through a guide means at the extremity of a tensioning arm, and through an aperture in the rotatable plate. The rotatable motion of the plate will cause the selvage threads to form the desired selvage.

9 Claims, 14 Drawing Figures

LENO MOTION DEVICE

The present invention relates to the formation of fabrics and more particularly, to an improved device for forming selvage during the weaving of fabrics.

The weaving of fabrics is well known in the art and many machines/apparatuses are employed in the weaving process. The basic weaving process comprises the steps of supplying a plurality of warp threads, forming a shed, inserting the weft threads, and beating-up the weft threads. To prevent the side edges of the fabric from fraying (an unlocking of the threads), it is known in the art to provide selvage on the fabric sides. The selvage generally comprises a pair of interlocking threads on each side, which interlocking threads "lock" the fabric to prevent the warp threads from becoming displaced.

The art is replete with examples of devices adapted for use in the formation of selvage. However, despite the many proposals, very few are presently used in the art due to relatively complicated construction which, when a malfunction occurs, causes extensive down-time for the whole weaving apparatus.

Accordingly, it is an object of the present invention to provide a device for forming selvage during the weaving of a fabric, which device is simple in construction and reliable.

It is a further object of the present invention to provide a selvage-forming device suitable for use with a weaving apparatus, the device including means for tensioning the selvage threads.

In the practice of the present invention, normally two selvage-forming devices will be employed with each weaving machine — one on each side thereof. Each device comprises a rotatable member which conveniently may be in the form of a "plate" or the like. The drive means to impart the rotational movement to the plate are preferably tied in with the drive means for the weaving apparatus for reasons which are apparent to those skilled in the art.

Mounted on one side of the rotatable plate member are first and second thread supply means for supplying the first and second selvage threads respectively. Also mounted on the same side of the plate as the thread supply means are first and second tensioning means associated with the first and second thread supply means respectively. The plate member further includes guide means associated therewith; each selvage thread passes from the thread supply means to its appropriate tensioning member and thence to the guide means from where it passes to the weaving apparatus.

In greater detail, the thread supply means may comprise any suitable supply of the selvage threads. Thus, a pair of diametrically opposed spools or bobbins of thread, which spools or bobbins are rotatably journalled, are mounted on the rotatable plate member. In the preferred embodiment, means are provided for adjusting the force required to withdraw thread from a bobbin or spool and this may conveniently be done by providing tension adjusting means on the bobbin mounting shaft. Each of the bobbins or spools is preferably mounted by means of a quick-release mounting as shown in the preferred embodiments hereof.

The rotatable plate member has associated therewith first and second guide means for said first and second selvage threads. The guide means may comprise any suitable although in the preferred embodiment, the guide means are such that the selvage threads pass from the side of the plate on which the thread supply means are mounted to the other side of the rotatable plate from where they go to the weaving apparatus. Thus, the guide means may, in the simplest embodiment, comprise an aperture in the plate through which the thread passes. Naturally, the first and second guide means are diametrically opposed on the plate. Alternatively, means may be provided on the periphery of the plate to function as a guide means.

The device of the present invention includes first and second tensioning means for use with the first and second thread supply means respectively, the tensioning means being mounted on the same side of the rotatable plate as the thread supply means. Generally, each tensioning means comprises an elongated arm which is journalled at one end on the plate. The other end of the arm has its own guide means through which the selvage thread passes when going from the supply means to the plate guide means. Preferably, the arm guide means comprise an aperture in the arm.

The length of the arm and the positioning of the same are important factors. In this respect, the effective length of the arm is the distance between the point at which it is journalled on the plate and the arm guide means. The length of each arm is established by determining the angle of yarn pull — this angle is measured between two lines. The first line would be that formed by the yarn as it goes from the arm guide means to the plate guide means or in other words, the line formed by the yarn when the arm is in a maximum position. The other line is a perpendicular one to the arm when the arm is in its maximum position. It is preferred that this angle be greater than approximately 23° since for several yarns, any lesser angle produces too great a strain on the yarn in pulling the arm as will be evident hereinafter. Preferably the angle formed is between 23° and 30°. It thus follows that the length of the arm will range between a length equal to the distance between the rotational centre of the plate and the plate guide means (hereinafter referred to as the radius) and a distance approximately 1.28 times the radius.

Having thus generally described the invention, reference will be made to the accompanying drawings illustrating an embodiment thereof, in which.

Figures 1, 2, 3, 4, 5:
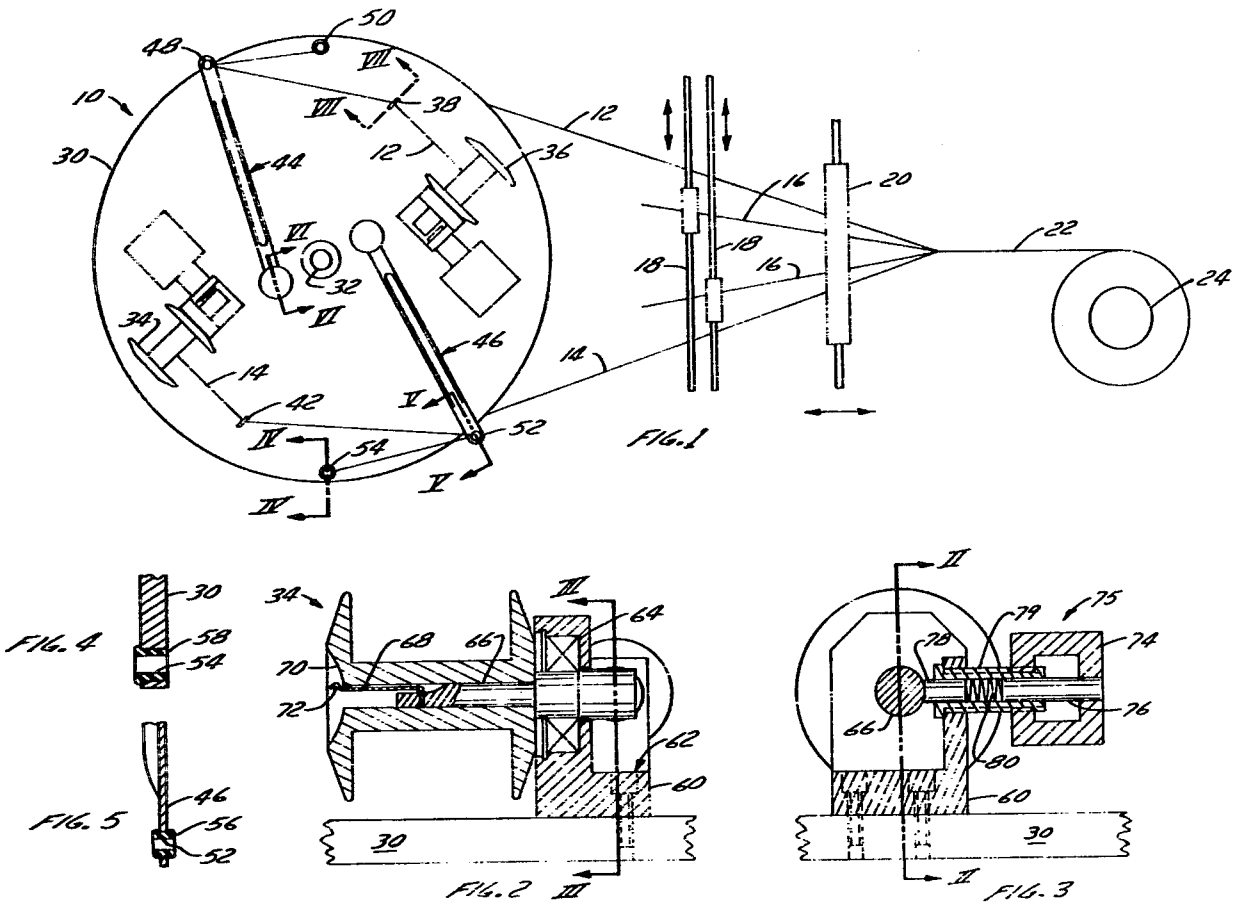
FIG. 1 is a side elevational view of a portion of a weaving apparatus embodying the improvement of the present invention.
FIG. 2 is a cross-sectional view of the bobbin mounting arrangement of FIG. 1.
FIG. 3 is a view taken along the line III—III of FIG. 2.
FIG. 4 is a cross-sectional view taken along the line IV—IV of FIG. 1.
FIG. 5 is a cross-sectional view taken along the line V—V of FIG. 1.

In greater detail and referring initially to FIG. 1, there is illustrated a weaving apparatus which includes a selvage-forming device generally designated by reference numeral 10.

The weaving apparatus further includes, as conventional components, means (not shown) for supplying warp threads 16, heddles 18, and a beater 20. The fabric 22 thus formed is wound on a suitable take-up roll 24.

Selvage-forming device 10 comprises a circular plate 30 journalled on shaft 32. Suitable means (not shown) are provided for rotatably driving plate 30; the drive means are tied in with other drive means of the apparatus in a manner well known to those skilled in this art.

Figure 7:
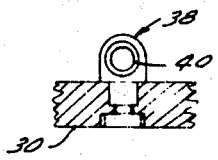
FIG. 7 is a cross-sectional view taken along the line VII—VII of FIG. 1.

Mounted on plate 30 are a pair of bobbins 34 and 36, which bobbins contain a supply of selvage threads 14 and 12 respectively. From bobbin 36, thread 12 passes through eyelet 38 which, as shown in FIG. 7, comprises a member secured to plate 30 and having a bushing 40 surrounding an aperture through which the thread passes. Bushing 40 may be of any suitable friction-reducing material such as a plastic or a ceramic material. Similarly, thread 14 passes through eyelet 42.

Mounted on plate 30 are a pair of tensioning arms 44 and 46 which are rotatably journalled on plate 30 and are associated with selvage threads 12 and 14 respectively. As seen in FIG. 1, selvage thread 12, after passing through eyelet 38, continues on through an aperture 48 functioning as a guide means at the outer extremity of arm 44. After passing through the aperture 48, selvage thread 12 passes through a guide means 50 in plate 30. In a similar fashion, thread 14 passes through aperture 52 in arm 46 and then through guide means 54 in plate 30. As shown in FIG. 5, at its outer extremity, arm 46 has a bushing 56 surrounding aperture 52 through which thread 14 passes. Similarly, plate 30 is provided with a bushing 58 surrounding aperture 54. In both cases bushings 56 and 58 are of a material suitable to reduce friction between the thread and material as it passes through the apertures.

Turning to FIGS. 2 and 3, it will be seen that bobbin 34 is mounted on plate 30 by means of a mounting member 60 which is secured to plate 30 by mounting screw 62. Bobbin 34 is rotatably mounted on mounting member 60 which has a bushing 64; shaft 66 on which bobbin 34 is rotatably mounted includes a bobbin retaining member 68. As may be seen, bobbin retaining member 68 has a "hook end" 72 which is adapted to engage a concave surface 70 at the outer extremity of bobbin 34. Thus, bobbin 34 may easily be released by depression of hook end 72 to release surface 70 from engagement with hook end 72.

A tension adjusting means is also associated with bobbin 34; the tension adjusting means is a member 75 having a conduit 79, a head 74, and a shaft 76. A pin 78 is located internally of conduit 79 with a spring member 80 between shaft 76 and pin 78 which bears on bobbin mounting shaft 66. Thus, the force exerted on shaft 66 could be varied if so desired.

Figure 6:
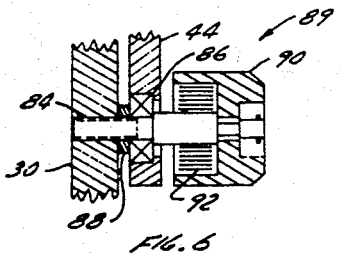
FIG. 6 is a cross-sectional view taken along the line VI—VI of FIG. 1.

As shown in FIG. 6, arm 44 is journalled on shaft 84 with a washer 88 between plate 30 and arm 44. A bushing 86 is also provided. Also provided is a tension adjusting member 89 which includes an adjusting head 90 and spring 92. By means of tension adjusting member 89, the spring force of arm 44 may be varied.

Figure 8A:
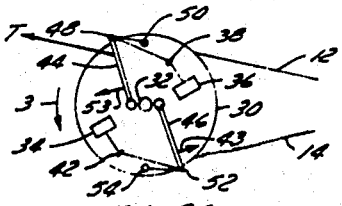
FIGS. 8A through 8E are schematic illustrations of the operation of the selvage-forming device.

Turning to FIG. 8A, and as previously discussed, selvage thread 12 from bobbin 36 passes through eyelet 38, aperture 48 in arm 44, and thence through guide means 50 to the reverse side of plate 30. Similarly, selvage thread 14 from bobbin 34 passes through eyelet 42, aperture 52 in arm 46, and through guide means 54 to the reverse side of plate 30. In the position shown in FIG. 8A, arm 44 is urged in the direction illustrated by arrow 53 such that the slack between spool 36 and guide means 50 is taken up. Similarly, arm 46 is biased in the direction indicated by arrow 43 to take up slack between spool 34 and guide means 54.

Figure 8D:
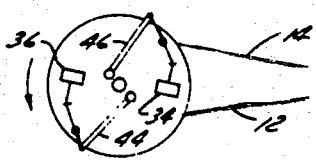
Figure 8B:
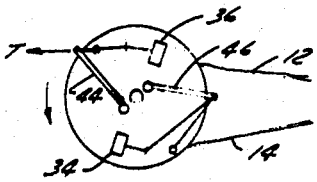

Turning to FIG. 8B, as plate 30 rotates in the direction of arrow 3, it will be seen that spool 36 is moving in a direction away from the use of selvage thread in the weaving apparatus and accordingly, the rate of withdrawal from spool 36 of selvage thread 12 is greater. Accordingly, arm 44 is not required to take up the same degree of slack and moves closer to guide means 50. On the other hand, spool 34 is moving closer to the use of the thread and accordingly, arm 46 takes up a greater degree of slack.

Figure 8E:
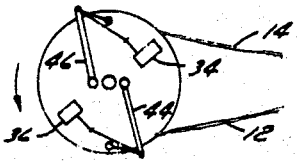
Figure 8C:
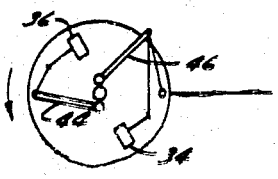

As shown in FIG. 8C, guide means 50 is at its greatest distance from the use of selvage thread 12 and accordingly, aperture 48 in arm 44 is aligned with guide means 50 — no slack is present in the thread. Conversely, arm 46 is situated at its furthest point from guide means 54 to take up the slack in selvage thread 14. It will also be noticed in FIG. 8C that selvage threads 14 and 12 are aligned with each other and at this point, they cross over each other to form an interlocking stitch on the weft threads.

In FIG. 8D, as guide means 50 moves closer to the use of selvage thread 12 in the weaving operation, arm 44 begins to take up the slack. In a corresponding manner, arm 46 moves closer to guide means 54.

In FIG. 8E, the position of arms 44 and 46 are reversed and the cycle begins over again.

Figure 9:
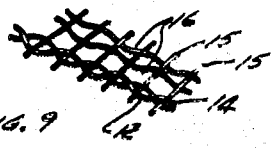
FIG. 9 illustrates the selvage threads in a fabric.

As shown in FIG. 9, the weaving operation produces a fabric which has warp threads 16 and weft threads 15 crossing over and under. Selvage threads 12 and 14 are interlocked at the edge of the fabric by the above-described device.

As will be seen from the above, each arm is tensioned to take up the slack in the selvage thread as it is being withdrawn by the loom or weaving apparatus.

Figure 10:
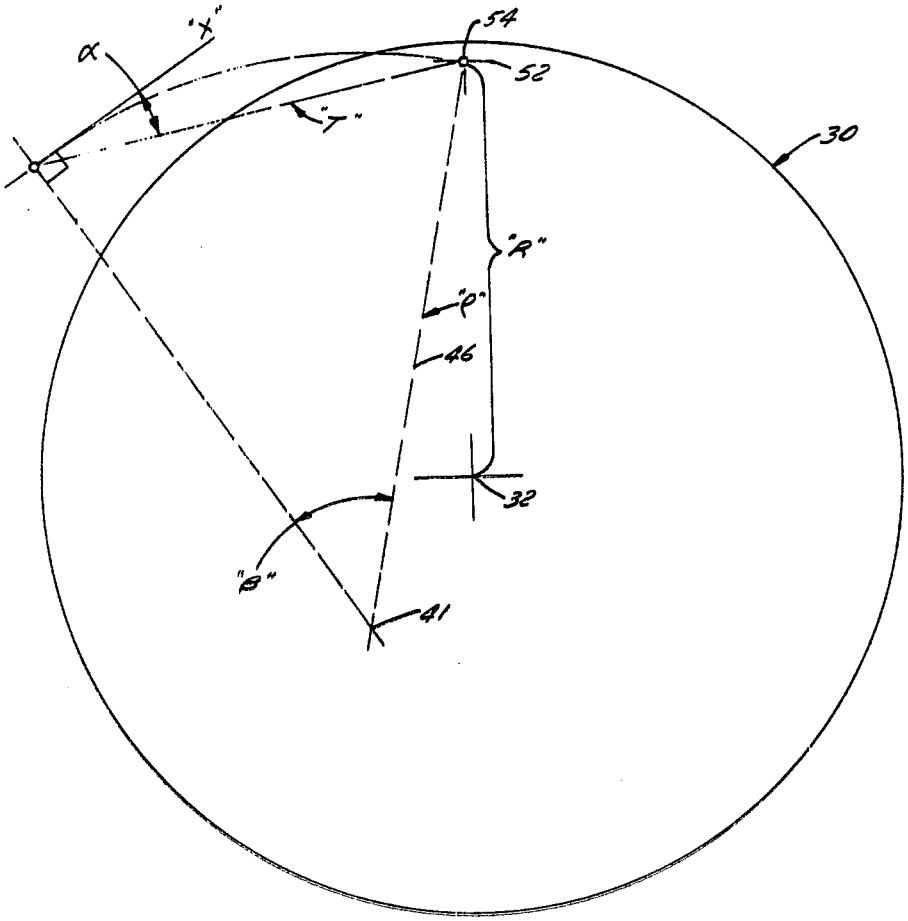
FIG. 10 is a schematic diagram illustrating the geometry of the yarn tensioning arm.

Referring to FIG. 10, the geometry of one of the tensioning arms is illustrated. Thus, arm 46 is pivoted at point 41 and is shown in two positions — the first wherein aperture 52 is in registry with plate guide means 54 and the second position wherein the arm is biased to its maximum extent. Taking R as the distance between the centre of rotation 32 of plate 30 and guide means 54, L represents the length of arm 46 betwen pivot point 41 and arm guide means 52, $\beta$ is the angle between the arm at its two extremities, T is the maximum length of yarn to be tensioned, X is a line perpendicular to the arm when biased to its maximum extent, and $\alpha$ is the angle formed between lines X and T. From the above, it may be seen that $$2l = T \operatorname{cosec}(\beta/2)$$

$$T = R$$

$$\beta = 2\alpha$$

then accordingly, $2l = R \operatorname{cosec} 2\alpha/2 = R \operatorname{cosec} \alpha$, and $l = R/2 \operatorname{cosec} \alpha$.

In the preferred embodiments, $\alpha$ is between 20° and 30° more preferably, between 23° and 28°. When $\alpha$ is less than 20°, for the manufacture of many fabrics, the strain on the selvage thread is too great for satisfactory commercial operation, although this will naturally vary depending on the particular yarn or thread being used.

It will be understood that the above-described embodiments are preferred ones only and changes and modifications may be made thereto without departing from the spirit and scope of the invention.

I claim:

1. A device for forming selvage in a weaving apparatus, said device comprising a rotatable plate member, first and second plate guide means associated with said plate member, first and second thread supply means mounted on one side of said plate member, and first and second tensioning members pivotably mounted on said one side of said plate member, each of said first and second tensioning members comprising an elongated arm having at one end thereof guide means through which thread passes from said supply means to an associated plate guide member, the other end of said arm being pivoted on said one side of said plate member such that said thread guide means and said plate guide means are aligned with each other under tensionless conditions, and means for biasing said arm so as to maintain tension on a thread passing from said supply means through said guide means to said plate guide means.

2. The device of claim 1 including means for adjusting said bias force of said arm.

3. The device of claim 2 wherein said plate guide means comprise an aperture extending through said rotatable plate.

4. The device of claim 2 wherein said guide means in said arm comprise an aperture.

5. The device of claim 2 wherein each of said elongated arms has a length equal to or greater than the distance between the centre of rotation of said plate and said plate guide means.

6. The device of claim 2 further including first and second eyelets associated with said first and second thread supply means for guiding thread to said tensioning arm.

7. The device of claim 2 wherein the angle formed between a line perpendicular to said tensioning arm when said tensioning arm is under maximum tension and a line formed by the thread extending between the arm guide means and plate guide means is between 20° and 30°.

8. The device of claim 7 wherein said angle is between 23° and 28°.

9. The device of claim 1 wherein each of said elongated arms has a length ($l$) as follows:

$$l = R/2 \operatorname{cosec} \alpha$$

wherein $R$ is the distance between the centre of rotation of said rotatable plate member and said plate guide means; and $\alpha$ is an angle formed between a line perpendicular to the elongated arm when biased to its maximum extent, and a line extending between said thread guide means and said plate guide means when said arm is biased to said maximum extent, $\alpha$ being between 23° and 30°.

* * * * *